US006557290B2

(12) United States Patent
Kumler

(10) Patent No.: US 6,557,290 B2
(45) Date of Patent: May 6, 2003

(54) ADJUSTABLE SHOTGUN CHOKE

(76) Inventor: Daniel F. Kumler, 8750 SE. 70th Ter., Ocala, FL (US) 34472

( * ) Notice: Subject to any disclaimer, the term of this patent is extended or adjusted under 35 U.S.C. 154(b) by 0 days.

(21) Appl. No.: 09/750,516

(22) Filed: Dec. 28, 2000

(65) Prior Publication Data

US 2002/0121040 A1 Sep. 5, 2002

(51) Int. Cl.[7] ..... F41C 21/18; F41C 27/00
(52) U.S. Cl. ..... 42/79; 42/79; 42/90
(58) Field of Search ..... 42/79, 90, 51; 89/14.05, 1.3; 285/305; 403/315–317

(56) References Cited

U.S. PATENT DOCUMENTS

| | | | | | |
|---|---|---|---|---|---|
| 688,227 | A | * | 12/1901 | Cory | 42/79 |
| 1,455,661 | A | | 5/1923 | Rhinehart | |
| 1,679,048 | A | * | 7/1928 | Miller | 42/79 |
| 2,558,200 | A | | 6/1951 | Schmeling | |
| 2,600,874 | A | | 6/1952 | Hoza | |
| 2,629,958 | A | | 3/1953 | Roper et al. | |
| 2,634,537 | A | | 4/1953 | Velez et al. | |
| 2,656,637 | A | | 10/1953 | Richards | |
| 2,656,638 | A | | 10/1953 | Cobb | |
| 2,662,326 | A | | 12/1953 | Powell | |
| 2,663,961 | A | | 12/1953 | White | |
| 2,676,429 | A | | 4/1954 | Gotterson | |
| 2,685,144 | A | | 8/1954 | Schroeder | |
| 2,700,839 | A | | 2/1955 | Finlay et al. | |
| 2,712,193 | A | | 7/1955 | Mathis | |
| 2,759,286 | A | | 7/1956 | Moore | |
| 2,866,288 | A | * | 12/1958 | Herter | 42/79 |
| 2,894,348 | A | | 7/1959 | Cutts | |
| 2,968,111 | A | * | 1/1961 | Steane | 42/79 |
| 3,045,378 | A | * | 7/1962 | Denaux | 42/79 |
| 4,058,925 | A | | 11/1977 | Linde et al. | |
| 4,510,843 | A | * | 4/1985 | Rabatin | 89/14.05 |
| 4,713,904 | A | | 12/1987 | Anderson et al. | |
| 4,726,280 | A | * | 2/1988 | Frye | 89/14.05 |
| 4,951,409 | A | * | 8/1990 | Froid | 42/90 |
| 5,133,143 | A | * | 7/1992 | Knight | 42/51 |
| 5,706,598 | A | * | 1/1998 | Johnston | 89/1.3 |
| 6,032,398 | A | * | 3/2000 | Carpenteri et al. | 42/90 |
| 6,052,935 | A | * | 4/2000 | Howard | 42/79 |

* cited by examiner

*Primary Examiner*—Michael J. Carone
*Assistant Examiner*—Lulit Semunegus
(74) *Attorney, Agent, or Firm*—Sven W. Hanson

(57) ABSTRACT

The present invention is a light weight low profile variable shotgun bore choke that is easily manually adjusted by the user. To minimize the choke profile, the choke is connected to the shotgun through a threaded connection within the muzzle bore. External threads on a choke inner sleeve are configured to mate with standard threads found in existing prior shotgun barrel muzzles or with custom threads specifically formed. By using a threaded connection internal to the gun barrel, the overall radial dimensions of the choke are minimized thereby reducing the profile visible to the user. Weight is also reduced by a design which reduces radial dimensions and by use of light weight materials. The choke is adjusted by the user by manually rotating an outer adjustment sleeve with respect to an inner bore sleeve which is fixed to the shotgun barrel. The adjustment sleeve rotates through a range of choke conditions between two physical stops. Various choke conditions are indicated by circumferential grooves that are easily viewed from any location around the choke.

7 Claims, 4 Drawing Sheets

ADJUSTABLE SHOTGUN CHOKE

BACKGROUND OF THE INVENTION

The present invention pertains to devices for altering the shot pattern obtainable from shotguns. In particular, the invention pertains to adjustable chokes for providing variable shot pattern with a single shotgun. This function has been addressed by a great variety of prior devices. Typically, one or more vents, barrel wall constrictions or enlargements and other structures are provided at the shotgun muzzle to compress or expand shot passing through the barrel. While such prior devices are somewhat successful in controlling shot pattern, they typically result in a firearm which is difficult to use or which detracts from the performance of the shotgun.

In both competition shooting and hunting, the additional weight of a shot pattern altering "choke" structure at the end of the gun barrel can render a shotgun more difficult to move and aim. In addition, in order to accomplish the desired functions, prior variable choke devices typically have radial dimensions significantly greater than the associated shotgun barrel. Because these larger structures are at the end of the gun barrel, the result is an obstruction to the user's sight when aiming at a target. In addition, prior variable chokes require too much attention by the user to be successfully used in a hunting environment, where the user may have to quickly make adjustments to shot pattern depending upon rapidly changing events. These adjustments may also have to be accomplished in low light. Prior devices which require careful visual scrutiny of adjustment markings are likely to be improperly used in such conditions. The prior device disclosed in U.S. Pat. No. 2,629,958 to W. F. Roper et al. provides examples of these failings. The Roper device is relatively large: projecting outward from the outer diameter of the gun barrel to which it is mounted. The Roper device also provides adjustment indicia in the form of surface lettering which is likely to be difficult to use in low light conditions. Another example of this type of design is presented in U.S. Pat. No. 2,634,537 to R. V. Velez et al. What is needed is a low profile, low weight adjustable shotgun choke which does not interfere with the effective use of the connected shotgun and may be quickly adjusted without the need for careful scrutiny.

SUMMARY OF THE INVENTION

The present invention is a light weight low profile bore choke that is easily manually adjusted by the user. To minimize the choke profile, the choke is connected to the shotgun through a threaded connection within the muzzle. External threads on a choke inner sleeve are configured to mate with standard threads found in existing prior shotgun barrel muzzles or with custom threads specifically formed. By using a threaded connection internal to the gun barrel, the overall radial dimensions of the choke are minimized thereby reducing the profile visible to the user.

The choke is adjusted by the user by manually rotating an outer adjustment sleeve with respect to an inner bore sleeve which is fixed to the shotgun barrel. The adjustment sleeve has longitudinal grooves to increase grip. The adjustment sleeve has internal threads which mate with external threads on the bore sleeve. When the adjustment sleeve is rotated, a tapered adjustment surface within the adjustment sleeve forces elongated fingers on the bore sleeve radially inward to form a bore constriction. This constriction converges in the direction of the mouth of the choke to cause the choking effect. Various taper designs including those known in the prior art are applicable to the present invention. The adjustment sleeve rotates between two physical stops to provide the full range of adjustment. Indicia are also provided to provide visual indication of the choke condition. These are preferably circumferential grooves that are easily visible from any position surrounding the choke. One physical stop is formed by a spring clip that is located between the bore sleeve and the adjustment sleeve. It is secured rotationally to the bore sleeve and biased against the inside of the adjustment sleeve. As the adjustment sleeve is rotated, a clip end drags against the adjustment sleeve until aligning with an aperture in the adjustment sleeve. The adjustment sleeve is prevented from being moved past an open condition by the interference of the clip end in the aperture. This operation of the spring clip increases safety of the choke in that the adjustment sleeve cannot be accidentally loosened or removed from the bore sleeve. To reduce weight, the adjustment sleeve is preferably formed of titanium. Additional advantages of the invention will become obvious from the following details and figures.

DETAILS OF THE PREFERRED EMBODIMENTS

Figure 1:
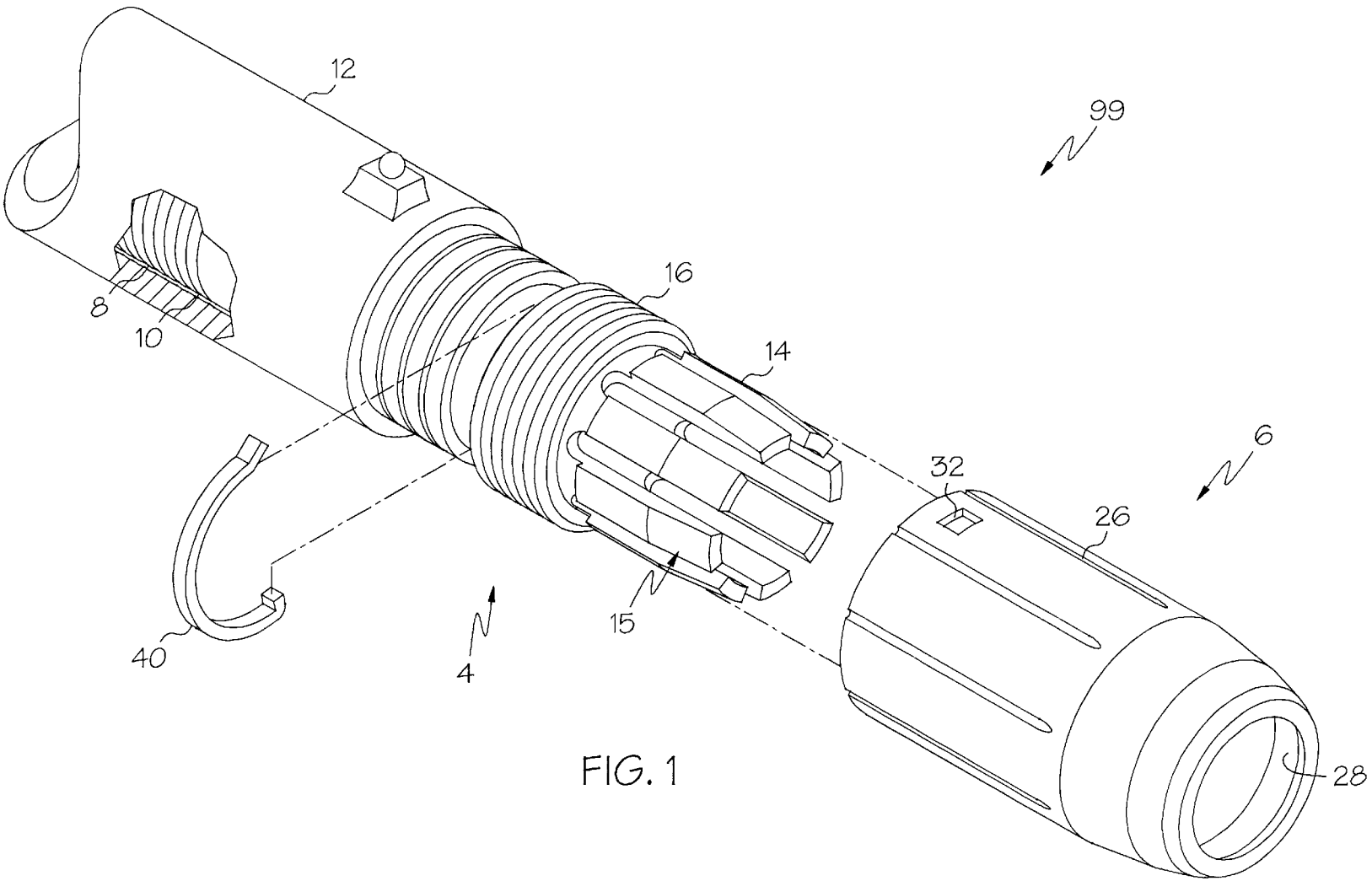
FIG. 1 depicts an exploded view of a choke according to the present invention secured to a shotgun muzzle.
Figure 2:
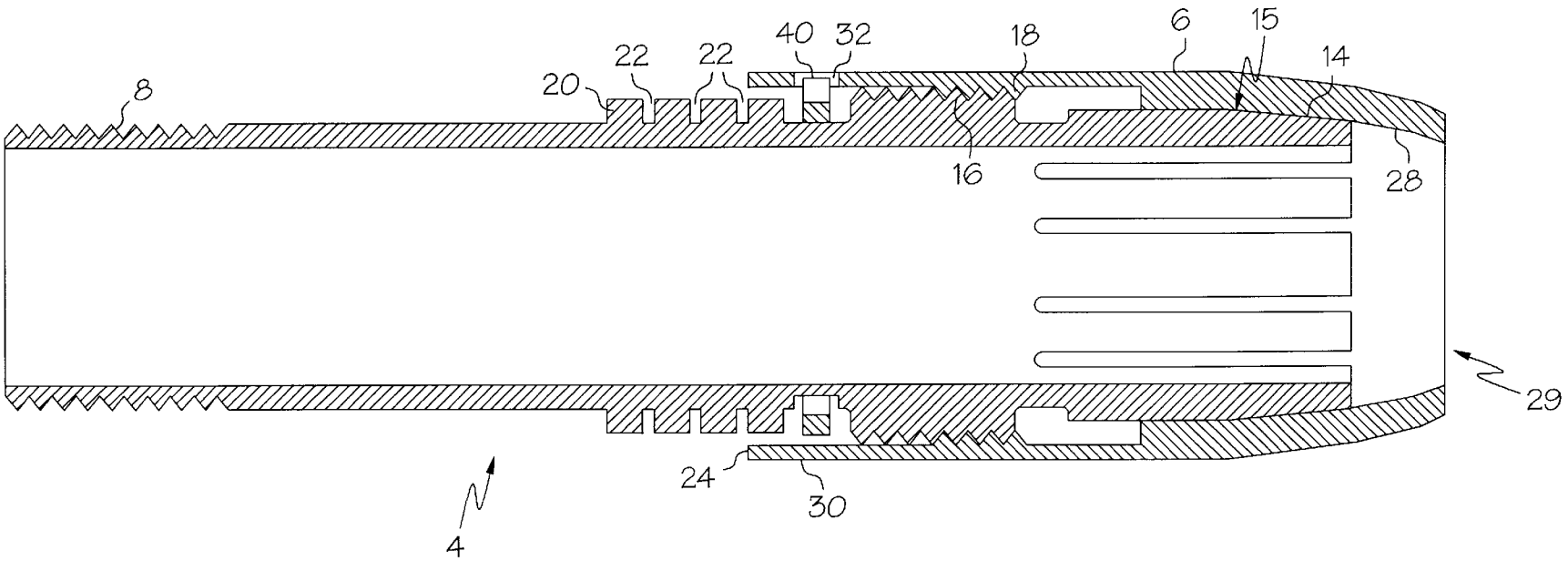
FIGS. 2 and 3 are longitudinal cross section views of open and fully "choked" conditions of one embodiment of the present invention.
Figure 3:
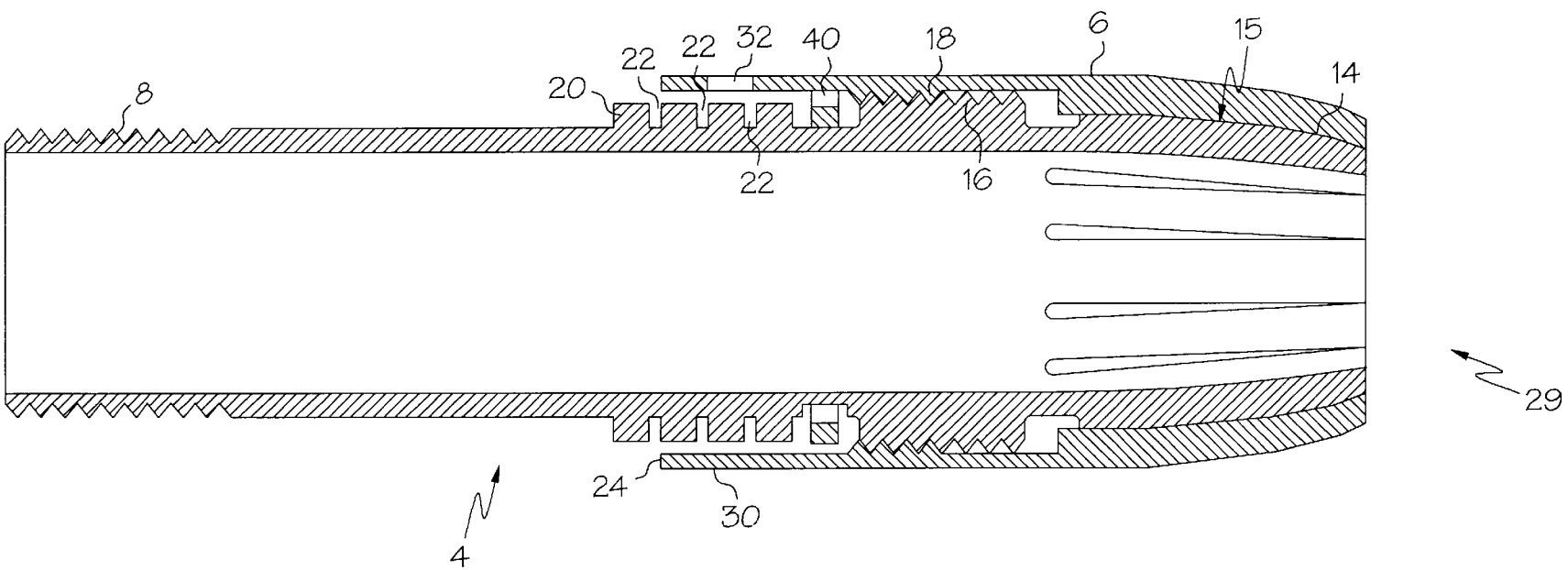

FIGS. 1, 2, and 3 depict a preferred embodiment of the present invention. A choke 99 consists of two primary parts: an inner bore sleeve 4 and an outer adjustment sleeve 6.

The bore sleeve 4 is generally in the form of an elongated cylinder and is positioned within a generally cylindrical cavity of the adjustment sleeve 6. Adjacent one end of the bore sleeve 4 external threads 8 are configured to mate with internal threads 10 located within the end of the barrel of a shotgun 12. Many shotguns currently available from consumer gun makers are provided with internal threads, such as shown in the figure, that are intended for use in attaching prior chokes. The bore sleeve external threads 8 may be configured to mate with these existing shotguns or a shotgun may have custom threads cut for the purpose. From the gun barrel internal threads to the gun muzzle, the gun bore has an increased internal diameter to accommodate the choke. Extending from the bore sleeve external threads, the bore sleeve has a length of smooth cylindrical sleeve with an external diameter fitting in close tolerance with the increased diameter portion of the shotgun bore. The internal diameter of the portion of the sleeve bore within the gun barrel is the same as the gun bore. The connection of the present choke to internal threads of the shotgun barrel is a critical feature of the invention. Only by using a connection within the barrel is a low profile choke possible. The prior art devices, that teach connection on the outside of a shotgun barrel, protrude unacceptably into the line of sight of the user when the gun is aimed. By using a connection at radial dimension less than the outer diameter of the gun barrel (an internal connection), the present invention provides a choke which has a minimum profile as viewed by the user. Appropriate materials and methods for constructing the bore sleeve are those known in the art for making similar devices.

At the opposite end of the bore sleeve 4, longitudinal slots are cut in the bore sleeve 4 to form elongated fingers 14. The fingers 14 are preferably of equal circumferential dimension although variation among the fingers is possible. There must be sufficient number of fingers 14 that each is narrow enough to allow their free ends to flex inwardly in a radial direction without permanently deforming. Most preferably eight fingers are used. For the same reason, the radial thickness of the fingers must also be small enough, and the fingers of sufficient length, to allow flexure with minimal force and without permanent deformation. The amount of flexure required in use is determined by the amount of "choke" or constriction of the bore that is required. The particular length of the fingers and their angle in choke conditions follows the existing knowledge of the art in this matter. Below, Table 1 provides characteristic parameters for a preferred device designed for use with a 12 gauge shotgun.

TABLE 1

Preferred Device Dimensions for a 12 Gauge Shotgun

| Characteristic | Inch (cm) |
|---|---|
| Bore inner diameter | 0.740 (1.880) |
| Finger length | 1.0 (2.54) |
| Finger tip radial deflection (full choke) | 0.02–0.03 (0.05–0.10) |
| Radial thickness at finger base | 0.066 (0.168) |
| Adjustment threads | 16 (TPI) |
| Thread form | double helix |

In the device described in Table 1, an adjustment thread having sixteen (16) threads per inch in double helix form provide a lead of 0.125 inch for a single revolution of the adjustment sleeve 6 on the bore sleeve 4. The adjustment sleeve taper 28 is formed such that two complete revolutions of the adjustment sleeve produces radial deflection of about 0.022 inch at the end of each finger—a full choke diameter reduction of 0.045 inch. The specific dimensions required will vary with the bore of the particular shotgun and the amount of choke required in each case. Generally, smaller gauge shotguns will have smaller finger deflections. However, the minimum finger thickness in all cases is also limited by strength requirements as the fingers are subjected to significant shock and vibration when the associated shotgun is fired, and must be prevented from breaking. To reduce stresses at the base of the fingers, it is suggested that each slot separating the fingers be terminated at the root by a round through-hole to distribute local stresses. The outside surface of the end of the fingers is tapered in decreasing radial dimension toward the tips as shown. These finger tapered surfaces 15 contact a mating surface on the adjustment sleeve 6 as discussed below.

Between the fingers 14 and the external threads 8 of the bore sleeve are a second set of adjustment threads 16. These adjustment threads 16 are used to connect, and adjust the axial location of, the adjustment sleeve 6 with respect to the bore sleeve 4. The adjustment sleeve 6 includes internal threads 18 that mate with the bore sleeve adjustment threads 16. The connectivity of these threads and the relative position of the two sleeves is shown in FIGS. 2 and 3 which are longitudinal cross section views of the device shown in FIG. 1. Details of this connectivity are discussed in a paragraph below. The adjustment threads and mating adjustment sleeve internal threads 18 are preferably of double helix form to provide the desired adjustment with a minimum of thread depth. This is essential to minimizing the overall radial dimension of the choke. The fit of the threads must also be such as to allow manual adjustment of the two parts.

Between the bore sleeve adjustment threads 16 and the external threads 8 are a series of circumferential lands 20 and grooves 22. These function to indicate the relative position of the adjustment sleeve 6 and implicitly the condition of the choke. The grooves are spaced and positioned to match the position of the trailing edge 24 of the adjustment sleeve 6 when the adjustment sleeve 6 is correctly located at desired choke adjustment positions. This gives indication of the choke condition that is quickly and easily recognizable by the user. Because the grooves 22 and trailing edge 24 extend completely circumferentially around the choke, the condition of the choke is discernable regardless of the relative position of the viewer. This allows quick and certain adjustment of the choke. Although the adjustment features of the present choke are operable with other means of indicating choke condition (such as those provided in the above referenced U.S. patents), the above is greatly preferred for the reasons given. Details of the positioning and spacing of the grooves are given in a following paragraph.

The adjustment sleeve 6 is generally a thin-walled cylinder having a central bore to accept the bore sleeve 4. The adjustment sleeve external surface is generally shaped to provide a secure grip to the user. Longitudinal partial-depth grooves 26 are provided for this purpose. The wall thickness of the adjustment sleeve 6 is generally as small as possible to both reduce weight and the radial profile of the choke. Because the adjustment sleeve 6 is the outermost element of the choke, it is the portion visible to the user when sighting the shotgun. With any choke, it is desired to minimize the distance the choke extends into the line of sight above the outer surface of the gun barrel. Minimizing wall thickness is also important to reducing weight. To help reduce both weight and choke profile, the adjustment sleeve is preferably made from a very high strength and low weight material. Most preferably, the material is titanium or a high titanium alloy. The inner surface of one end of the adjustment sleeve 6 has a taper 28 which ends in a minimum internal diameter at the mouth 29 of the adjustment sleeve 6. This taper 28 is the driver of choke adjustment. When the adjustment sleeve 6 is threaded to the bore sleeve 4, the adjustment sleeve taper 28 contacts the finger tapered surfaces 15. The two tapered surfaces, 15 and 28, are at least initially parallel to maximize the support surface on the outside of the fingers 14. When the adjustment sleeve 6 is forced axially over the fingers 14, the fingers are forced radially inward by the tapered interface, thereby reducing the bore internal diameter to create a converging bore and the desired choke effect. This operation is generally known to those skilled in the art. An initial taper angle of 3.5 degrees is preferred for use in conjunction with the parameters specified herein for a 12 gauge exemplary device. Preferably, the adjustment sleeve taper increases in angle toward the choke mouth 29—from left to right in the figure. This increased angle is necessary to maintain contact and pressure on the full length of the fingers as the fingers are flexed radially inward. In the embodiment shown, the taper is formed of three discrete sections of progressively increasing taper angle. Alternative configurations of increasing taper angle are contemplated including a taper surface with continuously increasingly taper angle. At the opposite end of the adjustment sleeve 6, the adjustment sleeve 6 has a skirt 30 which extends beyond the internal threads 18 to the trailing edge 24.

The relative axial location of the elements of both the bore sleeve 4 and the adjustment sleeve 6 are interrelated and linked to the choke performance requirements. The adjustment sleeve internal threads 18 and the bore sleeve external threads 16 must have secure engagement in all operational choke conditions. The lead of the threads and the adjustment sleeve taper 28 are preferably configured so that a 720 degree rotation of the adjustment sleeve 6 with respect to the bore sleeve 4 results in the full range of adjustment desired from the choke. At the same time, physical stops must be provided at the limits of the adjustment range. Either extremes of the choke setting range are easily perceived by the physical stops which prevent further rotation of the adjustment sleeve. Mid-range choke positions are found with little difficulty by viewing the adjustment sleeve 6 position relative to the circumferential grooves 22 on the sleeve bore.

Zero choke and full choke conditions of the preferred embodiment are depicted in FIGS. 2 and 3, respectively. At zero choke, each finger tapered surface 15 is in contact with the adjustment sleeve taper 28 without being significantly displaced. Rotation of the adjustment sleeve 6 to separate the adjustment sleeve 6 from the sleeve bore 4 is prevented by a physical stop created by a spring clip end 40 which is trapped in a aperture 32 in the skirt 30 of the adjustment sleeve 6. Details of the spring clip 42 are provided in a following paragraph. As the adjustment sleeve 6 is rotated, and moved axially relative to the fingers (to the left in the figures), the fingers 14 are displaced radially inward to create a converging section of bore and a partially choked condition. The adjustment sleeve 6 may be rotated further until the fingers 14 are displaced sufficiently that adjacent fingers contact and may not be displaced further as shown in FIG. 3. In the present embodiment this creates a physical stop limiting further adjustment sleeve rotation and also defining a full choke condition. Various other physical stops are contemplated including a rigid radial extending element on the bore sleeve that axially or radially contacts and stops the skirt trailing edge 24. The relative position of the adjustment sleeve 6 and therefore the condition of choke is indicated by the relative positions of the skirt trailing edge 24 and the circumferential grooves 22. In the figures, the three spaced grooves 22 are located on the sleeve bore 4 to align axially with the trailing edge 24 at the conditions of zero, mid and full choke, respectively. The grooves are defined by raised lands 20 which have a maximum radial dimension less than the internal diameter of the adjustment sleeve 6 to enable the adjustment sleeve 6 to move over the lands 20. Preferably, the visibility of the grooves are enhanced by filling them with a highly visible pigment or other coloration element. Unlike discrete indicia, such as numeric indicators which must be viewed from within a limited angle of view, the circumferential grooves are easily viewed from any position about the choke. In alternative embodiments, more or less than three grooves are used to indicate various relative choke conditions.

The particular range of choke condition provided by the present choke may be altered in a variety of ways. The minimum choke condition—in place of a straight bore as described above—may be a partial choke condition. This may be accomplished by having a preset minimum deflection of the fingers at the minimum choke stop. Alternatively, the fingers may be milled with a converging taper on their inside surfaces to provide a minimum choke when the fingers are undeflected. Other variations are also contemplated in other embodiments.

Figure 4B:
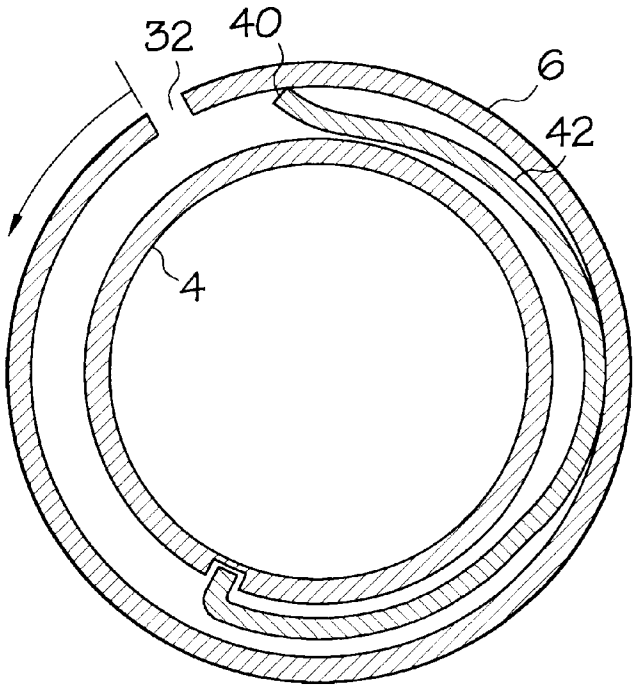
FIGS. 4*a* and 4*b* are cross section views of a choke in the conditions of FIGS. 2 and 3, respectively, and showing the operation of a spring clip.
Figure 4A:
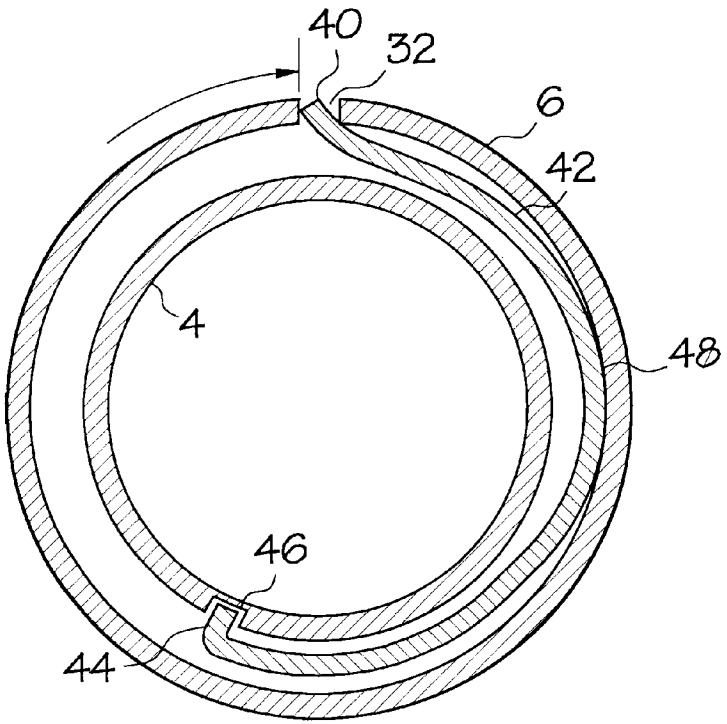

FIGS. 4*a* and 4*b* are two cross-sectional views of the configurations of FIGS. 2 and 3. FIG. 4*a* shows the relative position of the adjustment sleeve 6, bore sleeve 4, and interlocking spring clip 42. The spring clip is a stiff but resilient element that is rotationally fixed to the bore sleeve 4 by a down-turned arm 44 that is secured in a counterbore 46 in the bore sleeve 4. The spring clip 42 wraps around the bore sleeve 4 somewhat greater than 180 degrees to help retain the spring clip 42 to the bore sleeve. A spring clip end 40 rises at an angle to insert into the adjustment skirt aperture 32. The spring clip 42 is configured to bias the spring clip end 40 outward. The location of the aperture and the spring clip end is such that the adjustment sleeve is stopped at the point of zero choke. When the adjustment sleeve 6 is rotated to the zero choke position (moved to the right in FIGS. 2 and 3) the spring clip end 40 automatically springs into the aperture 32 to block further rotation. This operation is important for safety by preventing inadvertent loosening or removal of the adjustment sleeve. The width of the spring clip end is slightly less than the aperture. When the adjustment sleeve is rotated to increase effective choke (left to right in FIGS. 2 and 3) the angle of the spring clip 42 adjacent the clip end 40 allows the spring clip end 40 to slide out of the aperture 32 and allow the adjustment sleeve 6 to rotate. The spring clip end 40 slides with friction against the inside surface of the adjustment sleeve 6 which is beneficial to prevent a loose fit. The spring clip 42 has a protruding ovulated portion 48 which also bears against the adjustment sleeve to increase friction and ensure stability of the adjustment sleeve. The bore sleeve includes an outer retention groove 50 between the external threads 16 and the circumferential lands 20. The form and shape of the spring clip is such as to fit within the retention groove 50. Complete removal of the adjustment sleeve 6 may be accomplished by depressing the spring clip end 40 via the aperture 32 to allow the adjustment sleeve 6 to rotate past the zero choke position. An important benefit of the present spring clip design as a physical stop is its short overall radial dimension. The spring clip 42 may be formed of any of a variety of high strength steels, most preferably from what is commonly specified as 1065 and 1078 high carbon steel.

The above design features are directed in part to accomplishing a goal of minimizing radial profile. The internal threaded connection to the shotgun barrel is essential for this purpose. Following the above example for a 12 gauge shotgun, a variable choke according to the present invention was fabricated having a maximum overall radial dimension of one inch (2.54 cm)—approximately equal the outer diameter of a typical 12 gauge sport shotgun. Any radial dimension of ¼ inch or more greater than the connected shotgun outside diameter is considered too large due to resulting obstruction to sight and impaired esthetics. In the above description of examples of the present invention, the novel combination of design elements results in variable choke that is easier to use and provides improved performance over prior known devices. The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. An improved adjustable low profile shotgun choke for attachment to shotguns having internal threads within the shotgun muzzle, the choke comprising:

an inner sleeve having a bore and having:

a first end and second end, first external threads adjacent the first end, a plurality of separated longitudinal fingers adjacent the second end, second external threads between the first and second end;

an adjustment sleeve having inner threads engaged with the inner sleeve second external threads and the adjustment sleeve having a tapered inner adjustment surface, the adjustment surface contacting the flexible fingers, such that when the adjustment sleeve is rotated about the inner sleeve, the adjustment surface forces the fingers into a more converging condition;

a first and second stop limiting rotation of the adjustment sleeve with respect to the inner sleeve at a minimum and maximum choke position, respectively.

2. The choke of claim 1, wherein:

the first stop comprises:

a resilient clip between the inner sleeve and adjustment sleeve, the clip rotationally connected to the inner sleeve, and the clip having a clip end biased toward the adjustment sleeve; and the adjustment sleeve has an aperture receiving, in an open condition, the clip end such as prevent the adjustment sleeve from rotating past the open condition.

3. The choke of claim 1, further comprising:

indicia configured to indicate the position of the adjustment sleeve and visible from any radial position relative to the choke.

4. The choke of claim 3, wherein:

the indicia consists of at least one circumferential groove.

5. The choke of claim 4, wherein:

the choke is configured for a 12 gauge shotgun; and the choke has a maximum radial dimension of one inch.

6. The choke of claim 5, wherein:

the adjustment sleeve is formed substantially from titanium.

7. An improved shotgun having a removable choke capable of delivering shot in variable patterns, comprising:

a shotgun body having a barrel mouth having internal threads, and secured to the internal threads the device of claim 1.

* * * * *